US005080321A

United States Patent [19]

Carlson

[11] Patent Number: 5,080,321

[45] Date of Patent: Jan. 14, 1992

[54] CONCRETE FORM PANEL CONSTRUCTION

[75] Inventor: Michael G. Carlson, Lenexa, Kans.

[73] Assignee: Western Forms, Inc., Kansas City, Mo.

[21] Appl. No.: 518,790

[22] Filed: May 4, 1990

[51] Int. Cl.[5] ..... E04G 9/02; E04G 17/04

[52] U.S. Cl. ..... 249/196; 249/192; 249/193; 249/219.1

[58] Field of Search ..... 249/6, 8, 26, 27, 28, 249/47, 163, 167, 192-196, 219.1

[56] References Cited

U.S. PATENT DOCUMENTS

| | | | |
|---|---|---|---|
| 1,195,126 | 8/1916 | Witthoefft | 249/192 |
| 1,780,661 | 11/1930 | Wedberg | 249/27 |
| 1,936,740 | 11/1933 | Wolf | 249/192 |
| 2,017,553 | 10/1935 | Troiel | 249/19 |
| 2,677,868 | 5/1954 | Banneyer | 249/192 |
| 3,288,427 | 11/1966 | Plückebaum | 249/192 |
| 4,188,017 | 2/1980 | Dingler | 254/51 |
| 4,832,308 | 5/1989 | Slonimsky et al. | 249/78 |
| 4,955,579 | 9/1990 | Lee | 249/19 |

*Primary Examiner*—James C. Housel
*Attorney, Agent, or Firm*—Wm. Bruce Day

[57] ABSTRACT

A concrete form panel construction for adjoining adjacent form panel sections includes flanges or portions having opposing longitudinal grooves or apertures. Connectors extend between pairs of adjacent extension sections and have an opposed finger portion extensible into the grooves or apertures and clamp the paired extension sections together. The finger portions locate the pairs of extension sections against transverse movement and permit only, upon loosening and tightening, longitudinal movement. The advantage gained by the disclosed form panel construction is that it provides increased flexibility for concrete form construction without holes to admit concrete flashings, is adaptable to common configurations of pin lock devices and provides for a forming surface for a vertical section and a wood strip for easy nailing of a plywood floor section, as for a ceiling corner form.

4 Claims, 4 Drawing Sheets

CONCRETE FORM PANEL CONSTRUCTION

FIELD OF THE INVENTION

This invention relates to a concrete form and more particularly, the invention is directed to concrete form panel constructions which can be readily connected together.

BACKGROUND OF THE INVENTION

Multi-story structures, such as office buildings and parking garages, are often built one story at a time from reinforced poured concrete. Such structures require ceiling beams which are often stepped and of various thicknesses. For example, the thickness of the ceiling beams may be a greater thickness on lower floors and of lesser thickness on upper floors where less weight bearing capability is required.

OBJECTS OF THE INVENTION

It is a primary object of the present invention to provide a concrete form panel construction that includes an extension section, which may be of various heights, which is easily and readily connectable to a concrete form panel; and to provide an extension strip for a concrete form panel which is fixed transversely of the form panel but is movable and adjustable longitudinally; to provide such a form extension structure which provides for vertical surfaces and includes a wood strip for easy nailing of plywood floor sections; and to provide such a extension form which is adaptable to multiple uses and is easy and economical to manufacture and use.

Other objects and advantages of this invention will become apparent from the following description taken in connection with the accompanying drawings, wherein is set forth by way of illustration and example an embodiment of the present invention.

DESCRIPTION OF THE PREFERRED AND ALTERNATE EMBODIMENTS

As required by the statutes, detailed embodiments of the present invention are disclosed herein, however, the disclosed embodiment is merely exemplary of the invention which may be embodied in various forms. Therefore, specific structural and functional details disclosed herein are not to interpreted as limiting, but merely as a basis for the claims and as a representative basis for teaching one skilled in the art to variously employ the present invention in virtually any appropriately detailed structure.

Figure 1:
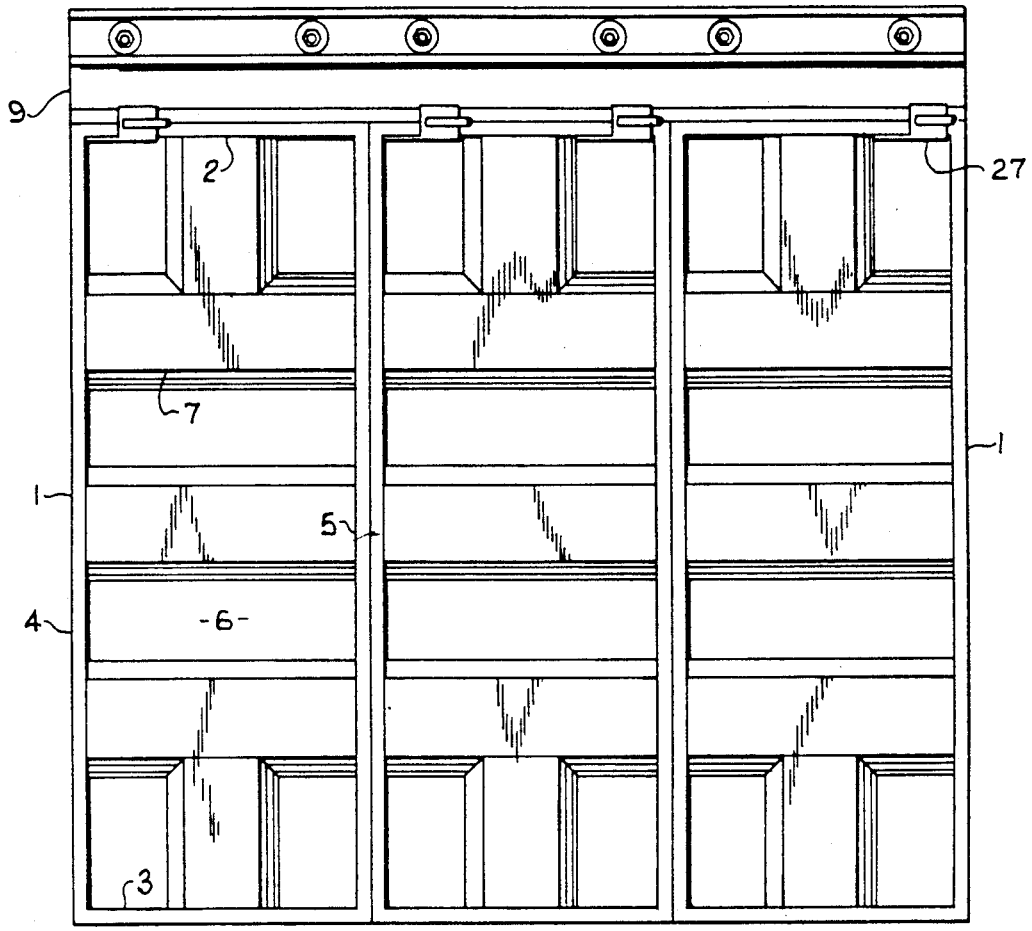
FIG. 1 is a elevational view of a preferred embodiment of the present invention shown with an assembled concrete form made from individual form panels.

Referring to FIG. 1, several concrete form panels 1 are joined together to create a wall form. Form panel 1 includes top and bottom end rails 2 and 3 and opposite side rails 4 and 5. The rails 2, 3, 4, and 5 are all secured to a form face plate 6 and are reinforced by transverse ribs 7. Typically, the form panels 1 are made in a standard range of heights and at times it is necessary to add a ceiling extension section 9 to the top for proper spacing for a ceiling of a desired height. In the illustrated example, FIGS. 1, 2 and 3, the extension system section 9 includes a lower flange rail 10 having a top surface and a bottom surface 11 and 12 with a longitudinal groove 13 extending into the bottom surface 12. An upstanding face portion 15 extends upwardly from the lower flange rail 10 and provides a form face for forming concrete thereagainst. An upper cradle means 16 consists of a U-shaped bracket with a right angle arm 17 forming, together with the face portion 15, a three-sided holder for a wood nailing strip 18. The wood nailing strip 18 is fixed in position by a fastener 19 which may be a screw or as in the illustrated example, a bolt.

Figure 3:
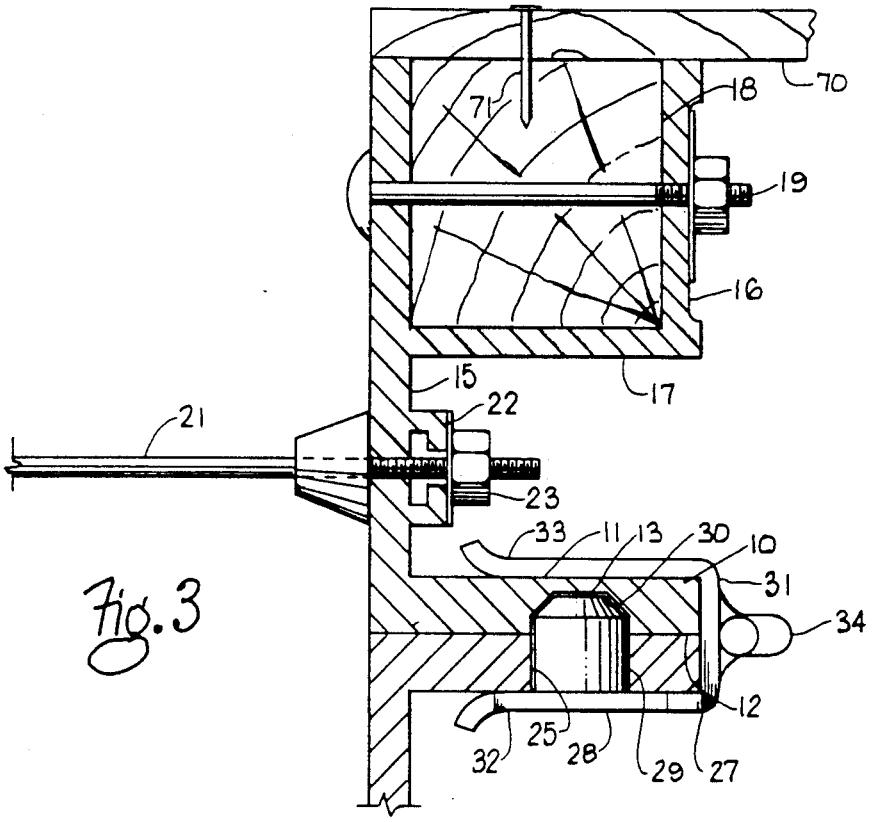
FIG. 3 is a cross-sectional view taken of the preferred embodiment and showing a form tie used therewith.

In the example shown in FIG. 3, a form tie 21 is emplaced to extend into the form area from the face portion 15 and to accommodate the stress caused by the form tie 21, the face portion 15 includes a reinforcement boss 22 extending from the face portion and against which a washer and nut 23 securing the form tie 21 are maintained.

To accommodate the extension section 9 the top end rail 2 of the form panel 1 to which the extension section 9 is fastened, is of the same dimensions as the lower flange rail 10 of the extension section 9 and includes, for example, a plurality of holes or apertures 25 extending therethrough at selected intervals. The apertures 25 align transversely with the groove 13 so that a connector pin, described below, may extend through the aperture 25 and into the groove 13. In the illustrated example, a connector secures the extension section 9 on the form panel 1 together and in the illustrated example, the connector is in the form of a pin lock 27 including a tang portion 28 carrying a pin 29 which is of a length to extend through the thickness of the top end rail 2 and into the groove 13. Preferably, the top surface 30 of the pin 29 is tapered so as to fit easily within the aperture 25 and groove 13. Further, in the illustrated example, the groove 13 is of a mating shape for the pin top surface 30. The pin lock 27 also includes a clip portion 31 with offset arms 32 and 33, each with upturned ends, to fit about the mated form panel rail 2 and extension section flange rail 10. A handle 34 facilitates attachment and detachment of the pin lock 27.

When the extension section 9 is mounted atop the form panel 1, it will be appreciated that the extension section may be moved longitudinally, but not transversely of the form panel 1 in order to facilitate adjustment and maintain proper alignment of the extension section 9 relative to the form panel 1. Use of the illustrated extension section facilitates adaptability in forming methods and in particular, may be used with the illustrated pin lock 27 when the distance between the extension section lower flange rail 10 and the overlying cradle means 16 is too short to permit use of conventional pins and wedges.

Figure 4:
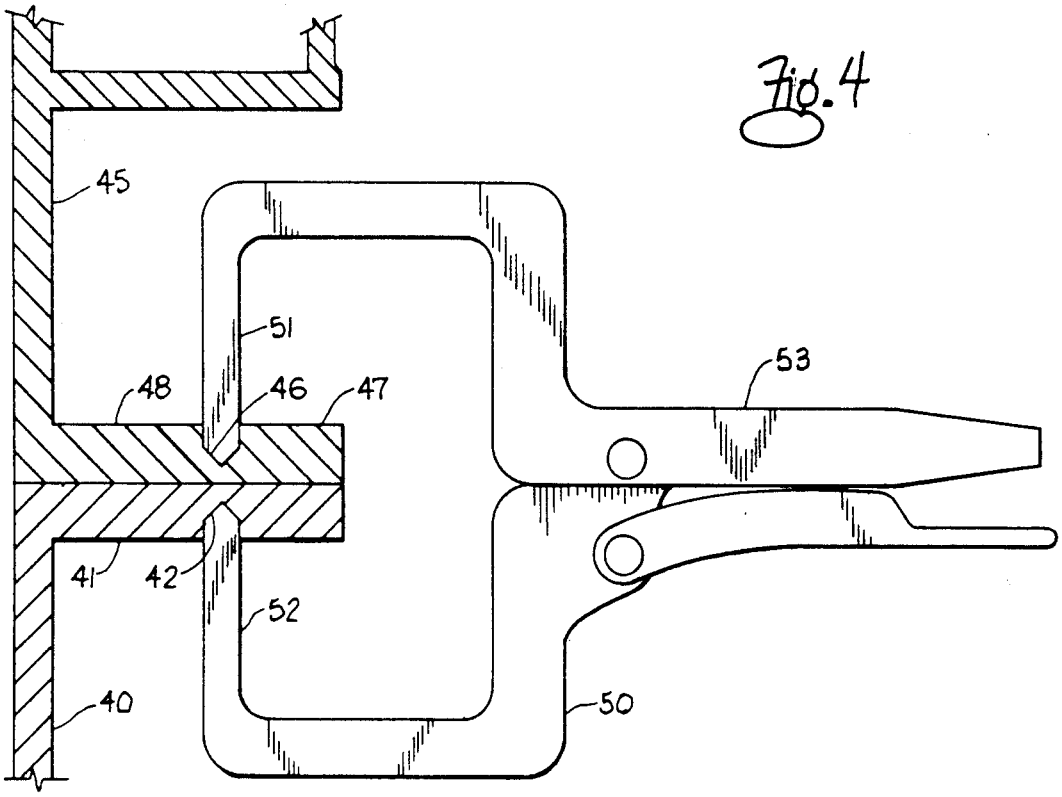
FIG. 4 is a cross-sectional view showing an alternate embodiment.

A second alternative embodiment is disclosed in connection with FIG. 4, wherein is disclosed the top end of a form panel 40 having a top end rail 41 including a longitudinal groove 42 therein. An extension section 45 is similar in configuration to the extension section 9 but includes a groove 46 extending downwardly into its lower flange rail 47 from a top surface 48 thereof. The grooves 42 and 46 are in longitudinal and transverse alignment. A connector in the form of a C-clamp 50 connects the form panel 40 and the extension section 45 together and includes opposing fingers 51 and 52 with tip ends which are received in the grooves 42 and 46. The C-clamp 50 includes an overcenter lock handle mechanism 53 for maintaining the clamp 50 in a closed and clamped position.

Figure 2:
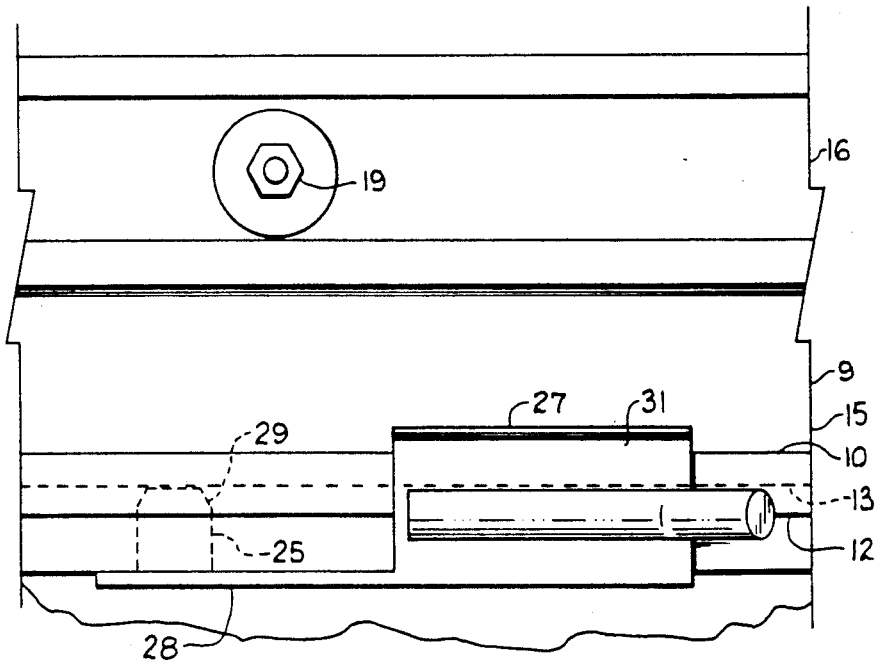
FIG. 2 is an enlarged fragmentary view taken from FIG. 1.
Figure 5:
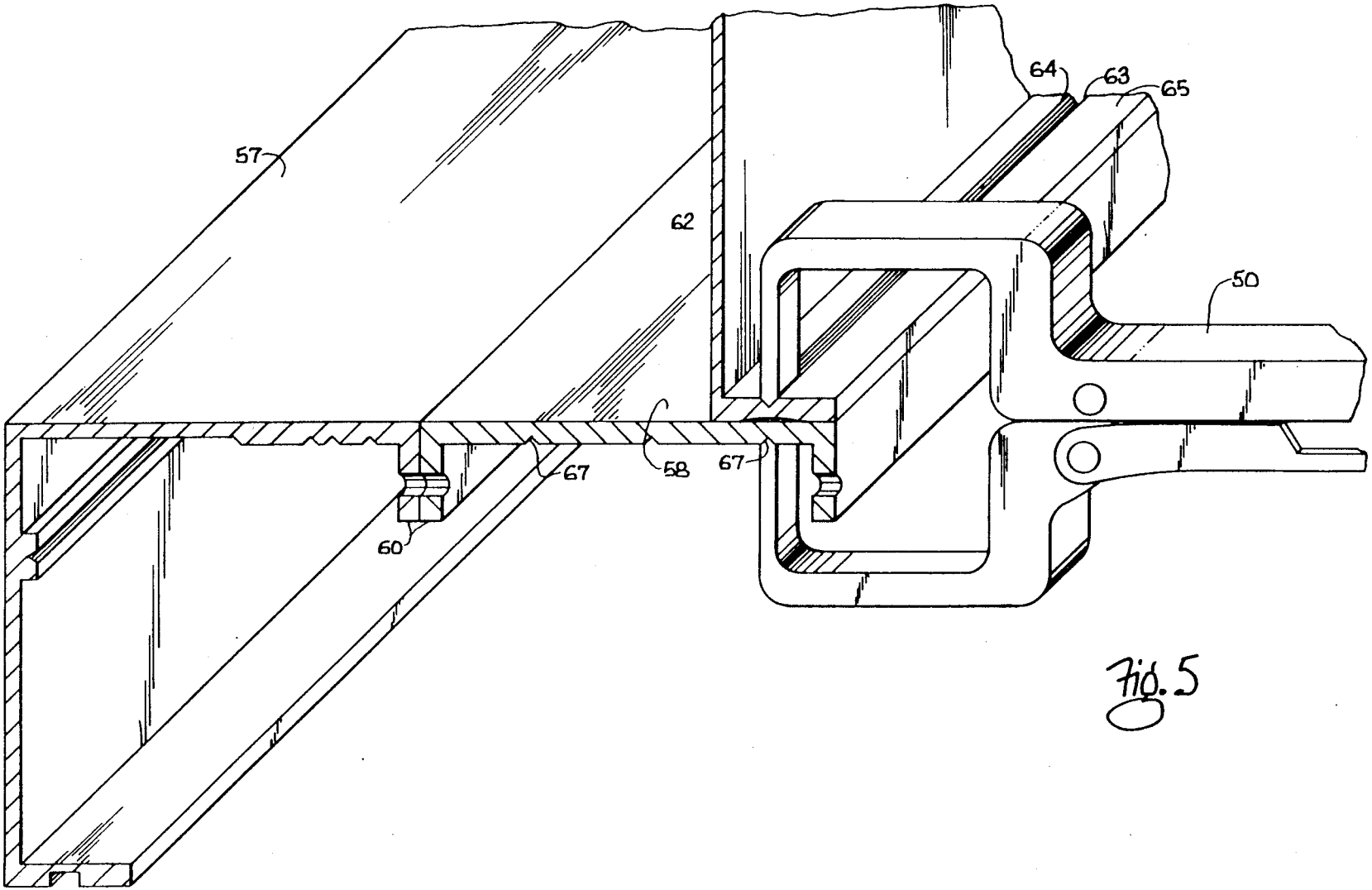
FIG. 5 is a perspective view showing a second alternative embodiment of the extension form.
Figure 6:
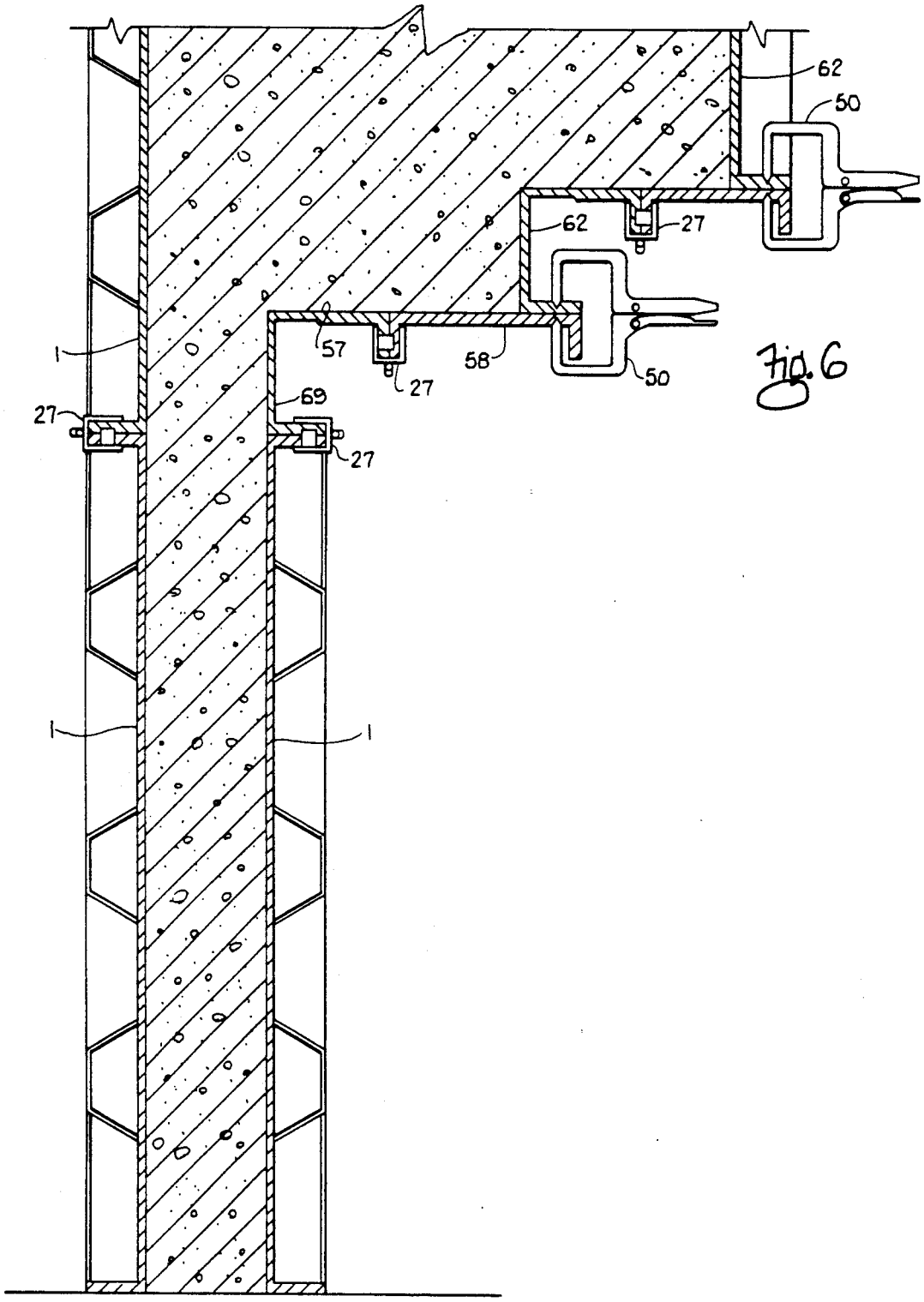
FIG. 6 is a cross-sectional view showing a form assembly constructed to a wall and ceiling beam structure.

The concept disclosed in connection with FIG. 4 may also be employed to connect form floor sections together, such as shown in connection with FIG. 5. Therein, floor sections 57 and 58 may be positioned atop a form panel 1 (not shown) and connected together at confronting flanges 60 by a conventional wedge pin means. An extension section 62 may be positioned atop the floor section 58 by the C-clamp connector 50. The extension section 62 includes a bottom flange 63 having a longitudinal groove 64 therein and extending downwardly from a top surface 65. A plurality of grooves 67 extend longitudinally of the floor section 57 and 58 and the extension section 62 is positioned generally over one of the grooves 67 to locate the extension section transversely of the floor section 57 or 58. With respect to the form shown in FIG. 5, this is a portion of an overall form configuration as shown in FIG. 6, wherein form panels 1 are secured to extension sections 69 and 70 as by the pin lock connection system used in connection with FIGS. 1 and 2. Other sections are connected by the opposing groove and C-clamp 50 connection method described in connection with FIG. 4. As an alternative to the connected floor sections 57 and 58, which may be of extruded aluminum, the extension section 9, shown in connection with FIGS. 1, 2 and 3, is readily adaptable to use with plywood for wooden floor forms wherein sheets of plywood 70 may be connected, as by a nail 71 to the wood nailing strip 18.

It is be to understood that while certain forms of this invention have been illustrated and described, it is not to be limited thereto, except insofar as such limitations are included in the following claims.

What is claimed and desired to be secured by Letters Patent is as follows:

1. A concrete form panel construction comprising:

(a) an elongate extension section having;

(i) a lower flange rail having a bottom surface with a longitudinal groove therein;

(ii) an upstanding face portion for forming concrete thereagainst;

(iii) an upper cradle means receiving a wood nailing strip for securing wood forms thereto;

(b) a concrete form panel having an end flange with a plurality of apertures aligned side by side along said flange and extending therethrough;

(c) a plurality of connectors extending between said extension section and said form panel and respectively having a pin portion extending through said aperture in said form panel end flange and into said groove in said extension section flange rail, and a clip portion extending about portions of said end flange and said flange rail.

2. A concrete form panel construction comprising:

(a) an elongate extension section having;

(i) a lower flange rail having a top surface with a first longitudinal groove therein;

(ii) an upstanding face portion for forming concrete thereagainst;

(iii) an upper cradle means receiving a wood nailing strip for securing wood forms thereto;

(b) a concrete form panel having an end flange with a bottom surface having a second longitudinal groove therein opposing said first longitudinal groove;

(c) a plurality of connectors extending between said extension section and said form panel and respectively having opposing finger means extensible into said first and second longitudinal grooves and clamp means urging said fingers and said flange rail and end flange together, said connectors restrictively locating said extension section with respect to said form panel against transverse movement.

3. A concrete form panel construction comprising:

(a) a concrete form panel having an end flange with a longitudinal groove therein;

(b) an elongate extension form section having a lower flange rail with a longitudinal groove therein; an upstanding form face, and an upper cradle means receiving a nailing strip; and (c) a plurality of connectors, the connectors each having opposed finger means engaging the longitudinal grooves and clamp means urging the finger means together for interconnecting said form panel and said extension form section.

4. A concrete form panel construction comprising:

(a) a concrete form panel having an end flange having a plurality of apertures aligned side by side along said flange and extending therethrough;

(b) an elongate extension form section having a lower flange rail with a longitudinal groove therein, an upstanding form face, and an upper cradle means receiving a nailing strip; and (c) a plurality of connectors, the connectors each having a pin portion engaging in one of said apertures and said groove and a clip portion engaging about the end flange and flange rail for interconnecting said form panel and said extension form section.

* * * * *